US007463010B2

(12) United States Patent
Dohnal et al.

(10) Patent No.: US 7,463,010 B2
(45) Date of Patent: Dec. 9, 2008

(54) MULTIPOINT SWITCH

(75) Inventors: Dieter Dohnal, Lappersdorf (DE); Albert Schmidbauer, Roding (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 509 days.

(21) Appl. No.: 10/551,600

(22) PCT Filed: Feb. 20, 2004

(86) PCT No.: PCT/EP2004/001648

§ 371 (c)(1),
(2), (4) Date: Sep. 30, 2005

(87) PCT Pub. No.: WO2004/088693

PCT Pub. Date: Oct. 14, 2004

(65) Prior Publication Data

US 2006/0244431 A1 Nov. 2, 2006

(30) Foreign Application Priority Data

Apr. 3, 2003 (DE) ..... 103 15 206
Apr. 3, 2003 (DE) ..... 103 15 207

(51) Int. Cl.
*G05F 1/147* (2006.01)

(52) U.S. Cl. ..... 323/256; 318/626; 318/563

(58) Field of Classification Search ..... 323/234, 323/244, 247, 255, 256; 318/626, 652, 563, 318/566, 590–593
See application file for complete search history.

(56) References Cited

U.S. PATENT DOCUMENTS

| | | | | |
|---|---|---|---|---|
| 4,207,445 | A * | 6/1980 | Hammar | 200/11 TC |
| 6,060,669 | A * | 5/2000 | Dohnal et al. | 200/11 TC |
| 2001/0013784 | A1 * | 8/2001 | Frotscher et al. | 324/547 |

FOREIGN PATENT DOCUMENTS

| | | |
|---|---|---|
| DE | 197 43 864 | 4/1999 |
| GB | 419 283 | 3/1934 |

OTHER PUBLICATIONS

Stufenschalter Typ M (Maschinenfabrik Reinhausen, Jun. 1993).
Stufenscahlter Typ M Und MS (Maschinenfabrik Reinhausen, Jul. 1993).

* cited by examiner

*Primary Examiner*—Bentsu Ro
(74) *Attorney, Agent, or Firm*—Andrew Wilford

(57) ABSTRACT

The invention relates to a multipoint switch for continuously switching different coil branches of a step-down transformer. According to said invention, at least one torque motor associated to various drive configurations carries out different driving functions for individual groups, thereby substituting a conventional motor.

16 Claims, 16 Drawing Sheets

Figure 2:
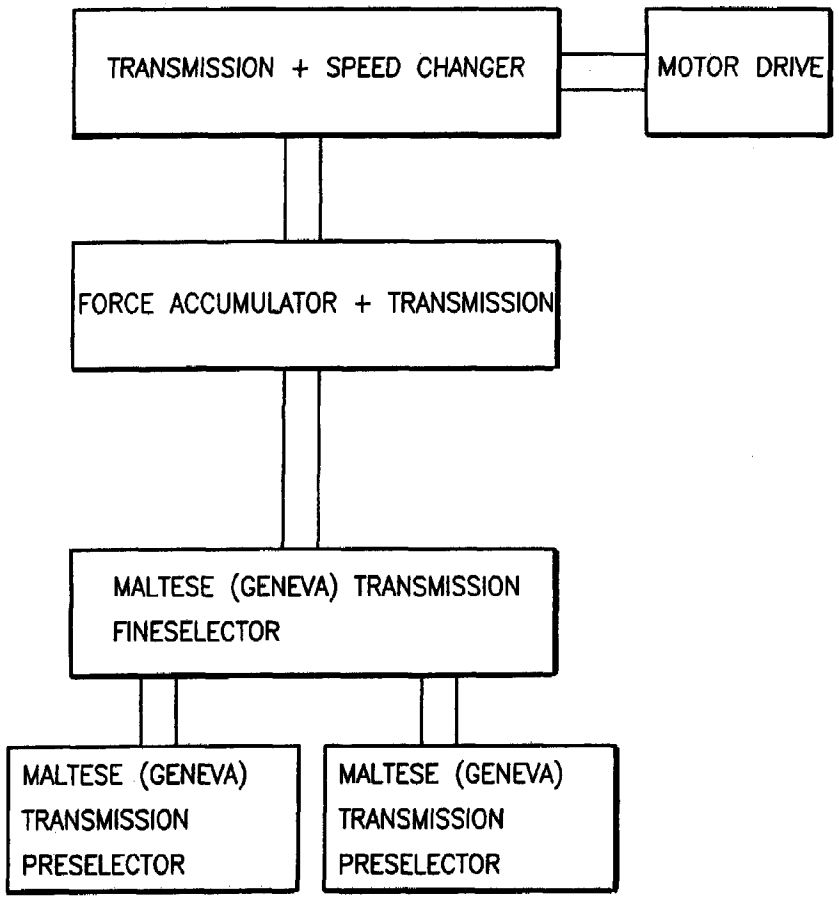
Fig. 2 PRIOR ART

| REPLACEMENT: | LOCATION OUTSIDE THE TRANSFORMER |
|---|---|
| TRANSMISSION + SPEED CHANGER | POSITIONING UNIT: TRANSMISSION<br>FORCE ACCUMULATOR + TRANSMISSION<br>MALTESE (GENEVA) TRANSMISSION FINE SELECTOR<br>MALTESE (GENEVA) TRANSMISSION PRESELECTOR |
| TRANSMISSION + SPEED CHANGER<br>FORCE ACCUMULATOR + TRANSMISSION | POSITIONING UNIT: FORCE ACCUMULATOR<br>–<br>MALTESE (GENEVA) TRANSMISSION FINE SELECTOR<br>MALTESE (GENEVA) TRANSMISSION PRESELECTOR |

Fig.4a

| REPLACEMENT: | LOCATION INSIDE THE TRANSFORMER |
|---|---|
| TRANSMISSION + SPEED CHANGER | – |
| TRANSMISSION + SPEED CHANGER<br>FORCE ACCUMULATOR + TRANSMISSION | –<br>POSITIONING UNIT: FORCE ACCUMULATOR<br>MALTESE (GENEVA) TRANSMISSION FINE SELECTOR<br>MALTESE (GENEVA) TRANSMISSION PRESELECTOR |

Fig.4b

| REPLACEMENT: | LOCATION INSIDE THE TRANSFORMER |
|---|---|
| TRANSMISSION + SPEED CHANGER | – |
| FORCE ACCUMULATOR + TRANSMISSION | POSITIONING UNIT: FORCE ACCUMULATOR |
| MALTESE (GENEVA) TRANSMISSION FINE SELECTOR | POSITIONING UNIT: MALTESE (GENEVA) TRANSMISSION FINE SELECTOR<br>MALTESE (GENEVA) TRANSMISSION PRESELECTOR |
| TRANSMISSION + SPEED CHANGER | – |
| FORCE ACCUMULATOR + TRANSMISSION | POSITIONING UNIT: FORCE ACCUMULATOR |
| MALTESE (GENEVA) TRANSMISSION FINE SELECTOR | POSITIONING UNIT: MALTESE (GENEVA) TRANSMISSION FINE SELECTOR |
| MALTESE (GENEVA) TRANSMISSION PRESELECTOR | POSITIONING UNIT: MALTESE (GENEVA) TRANSMISSION PRESELECTOR |

Fig.5b

| REPLACEMENT: | LOCATION INSIDE THE TRANSFORMER |
|---|---|
| TRANSMISSION + SPEED CHANGER<br>FORCE ACCUMULATOR<br>MALTESE (GENEVA) TRANSMISSION SWITCHING COLUMN<br>MALTESE (GENEVA) TRANSMISSION PRESELECTOR | – |
| TRANSMISSION + SPEED CHANGER<br>FORCE ACCUMULATOR<br>MALTESE (GENEVA) TRANSMISSION SWITCHING COLUMN | –<br>POSITIONING UNIT: FORCE ACCUMULATOR MALTESE (GENEVA) TRANSMISSION SWITCHING COLUMN<br>–<br>MALTESE (GENEVA) TRANSMISSION PRESELECTOR |
| TRANSMISSION + SPEED CHANGER<br>FORCE ACCUMULATOR<br>MALTESE (GENEVA) TRANSMISSION SWITCHING COLUMN<br>MALTESE (GENEVA) TRANSMISSION PRESELECTOR | –<br>POSITIONING UNIT: FORCE ACCUMULATOR MALTESE (GENEVA) TRANSMISSION SWITCHING COLUMN<br>–<br>POSITIONING UNIT: MALTESE (GENEVA) TRANSMISSION PRESELECTOR<br>– |

Fig.6b

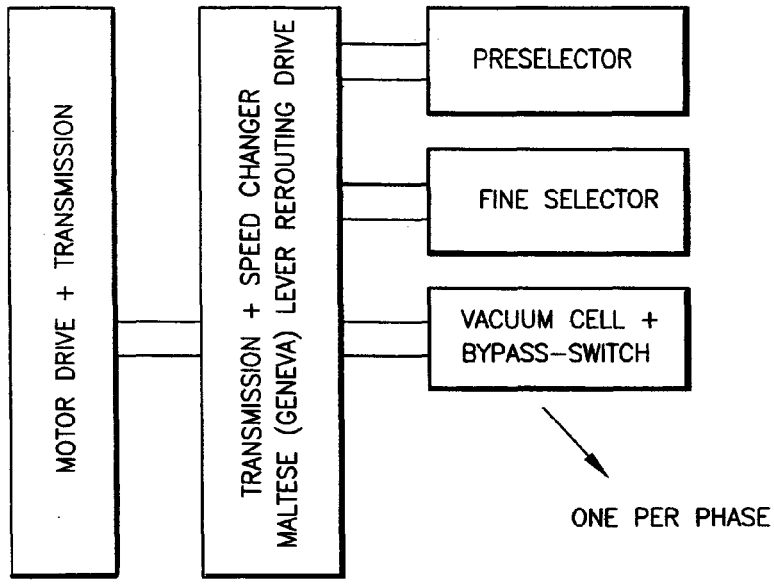
PRIOR ART Fig.7
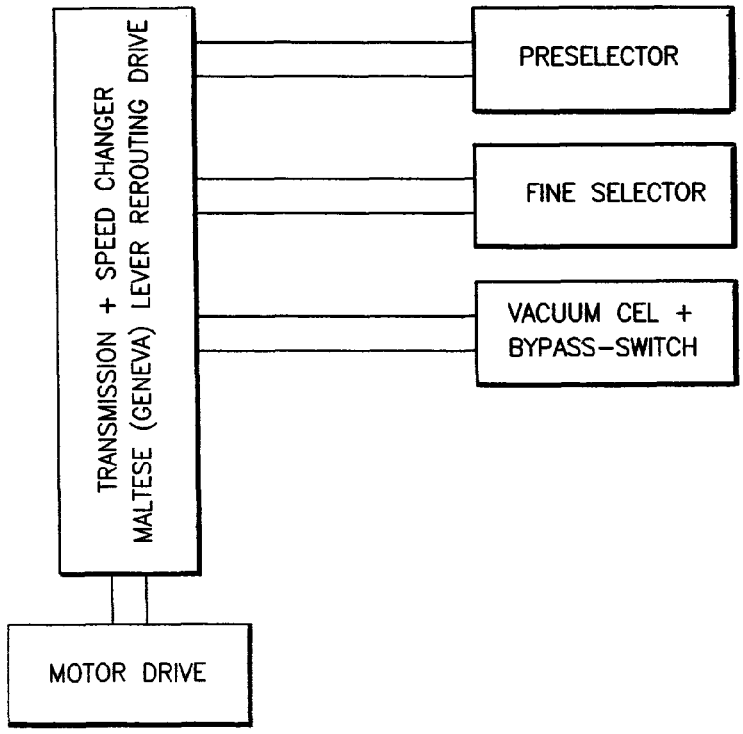
PRIOR ART Fig.8

MULTIPOINT SWITCH

CROSS REFERENCE TO RELATED APPLICATIONS

This application is the U.S. national phase of PCT application PCT/EP2004/001648 filed 20 Feb. 2004 with a claim to the priority of German patent application 10315206.7 itself filed 3 Apr. 2003 and German patent application 10315207.5 itself filed 3 Apr. 2003.

The invention relates to a tap changer for the interruption-free [continuous under load] switchover between different winding taps of a control transformer.

Tap changers have been available for decades for voltage regulation ensuring high electrical energy supply quality. Their principal modes of operation allow them to be subdivided into resistance-type high speed switches and reactor switches respectively.

The principle of all resistor-type high speed switches [for use in on load tap changers] goes back to the German Patent 474,613 which issued in 1929 and that describes for the first time the principle of the make-before-break interruption-free switchover between different transformer winding taps by means of the insertion of a bridging resistor. Tap changers based on this principle are known in numerous embodiments. A typical representative is the type "M" tap changer which is described in the brochure "Tap Changer Type M-Inspection Procedure" of the assignee of the present application. This on-load tap changer has a tap selector which permits a load free selection of the winding tap to which the device is to be switched and, in a separate oil filled vessel arranged spacedly thereabove, an on-load switch for the switch interrupt-free switchover. The actuation of this on-load tap changer is effected through a motor drive with an electric motor which is set in operation upon such a switchover on the one hand by the fine selector and optionally through a preselector to run continuously and on the other hand actuates the on-load switchover through a force accumulator. The motor drive itself lies spatially laterally of and external to the transformer.

Through rods, chambers, transmission stages and mechanical geneva or maltese intermittent or escapement drives, the energy is delivered to the tap changer. When the force accumulator has reached its end position, that is, is fully retracted, it is liberated from its arresting device and the spring energy movement or jump operates the load switchover.

Figure 1:
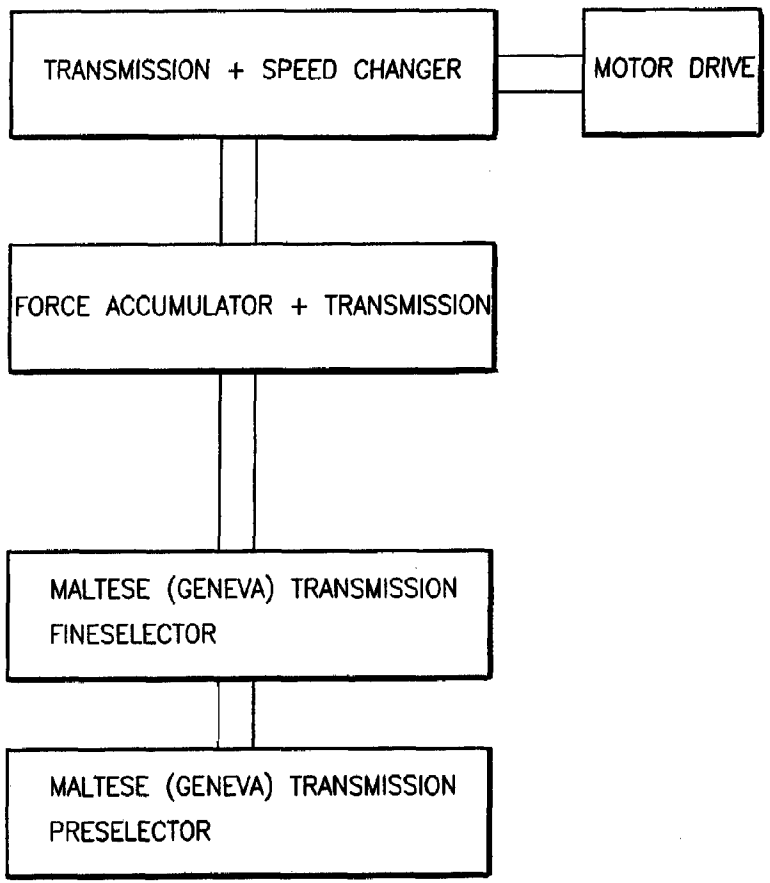
Fig. 1 PRIOR ART

In FIG. 1 the operating course or drive train of such a known on load tap changer has been schematically illustrated. In FIG. 2 a modification of such an on load tap changer has been shown which instead of the usual preselector has a multiple coarse selector; this arrangement is also known to the worker in the art.

A further tap changer has been described in the brochure "Load Selector Type V-Inspection Instructions" of the assignee of this application. In this type "V" load selector, the preselection of the respective transformer winding tap to which the switchover is to be made and the components for the subsequent switchover to it are structurally united. In this case as well, a motor drive is provided with the aforementioned spatial arrangements and which initially pulls in the spring energy or force accumulator. After the force accumulator has been fully retracted and subsequently triggered, a rotatable switching shaft is actuated that, rapidly and without interruption, causes switchover from one fixed contact to a neighboring to another fixed contact, each electrically connected to a transformer winding tap. A typical drive train of such a known load selector has been illustrated schematically in FIG. 3.

A tap changer of the reactor switching type is for example known from German Patent 4,126,824 as well as from the booklet "Load Tap Changer Type RMV-1 of Reinhausen Manufacturing Inc., Alamo, Tenn., USA." They describe two load branches which can be preselectable with a tap changer and between which in each of the switchover phases, a switch, here a vacuum switching cell, is connected. Each vacuum switching cell can be bridged by a bypass contact which in turn can connect at least one of the two load branches with the load output. The actuation of the vacuum switching cells is effected by respective force accumulators [spring energy accumulators] which can be drawn in by the movement of a drive shaft. For each of the switched phases, between the bypass contact and the force accumulator a double sided cam is arranged which is rotated through 180° by the drive shaft for each switching step. On the side of the double sided cam turned toward the bypass contact there is a groove for controlling the bypass contact and on the opposite side a further groove for controlling the force accumulator which drives the vacuum switching cell. The control of the force accumulator is thus such that for each switching step it is first compressed and then released and thereby can actuate the vacuum switching cell. For actuation of this tap changer, therefore, a motor drive with an electric motor is provided which enables the switchover and on the one hand allows continuous actuation of the selector contacts and on the other, through the described cams, both the bypass contact which can also be continuously actuated and also draws in the described force accumulators. When the force accumulator has reached its end position, that is has been fully drawn in, its arresting member is released and by spring energy actuates the load switch. In FIG. 7 the operating train of this known tap changer has been schematically illustrated.

A further tap changer of the reactor switching type is already known from German Patent 19 743 864 from which the functional distinction between reactor-principle switching on the one hand and resistance high speed switching on the other can be seen. In this known tap changer, in a housing for each phase, fixed selector contacts are provided which are switchable by two movable selector contacts. Further, for each phase, preselector contacts are provided. For each phase, bypass contacts are also provided and each vacuum switching cell is actuated by means of a fastener accumulator. In a separate lateral housing part a single operating mechanism is provided for actuating all of the movable contacts and all of the vacuum switching cells in the corresponding switching sequence, whereby this single drive operates with an insulated shaft extending through the housing and acting upon the individual components. A typical operating train of this known tap changer is illustrated in FIG. 8.

With the known tap changers, the drive is effected by an electric motor drive. Such a drive is for example described in WO 98/38661. In such a known motor drive, all of the mechanical and electrical components which are required to drive the tap changer are united. The important mechanical components are the load drive and the control drive. The load drive actuates directly the tap changer. It has, for that purpose a correspondingly dimensioned electric motor. The control drive contains a cam disk which with each switch operation of the tap changer rotates through a complete revolution. The cam disks, in addition, have a plurality of switching cams for the mechanical actuation of numerous cam switch or cam-actuated contacts. The control drive also contains means is for indicating the tap position or the switching step or operation or mode. The electrical components of the motor drive have various circuitry assigned thereto. Thus a motor current circuit is provided to which the terminals of the electric drive motor are connected through motor protectors [circuit breakers, fuses], brake protectors and other circuitry and switching means connected with the current supply lines. Furthermore, a control current circuit and various reporting or indicating current circuits and triggering current circuits for the motor protection switches may be provided.

The control of the motor drive itself is effected in accordance with the principles of step switching, that is a device is provided to trigger a switch step with each single control pulse and enable the switch then to proceed to the end of the specific switching step or operation. The output shaft of the motor drive which is coupled with drive shaft of the tap changer then is able to carry out, after the single control pulse tripping a predetermined exact number of revolutions. In addition, the known motor drive has, apart from other safety devices a continuous protective device which prevents, in the event of failure of the described step control, the motor drive from continuing to its end position.

The described known motor drive has together with the maltese or geneva escapement transmission downstream thereof in the tap changer of the resistance principle high speed switching type, a whole array of functions to fulfill:

producing a rotational torque with subsequent conversion is into a movement for the tap selector;

transmission of the torque with step up or step down transmission;

drawing in the force accumulator;

conversion of a continuous movement into a stepped movement;

fixing the switching elements after a completed switching step;

position signaling or indication;

mechanical stop or end function.

As a consequence, conventional motor drives for this purpose and their transmissions connected to these motor drives have been of complicated construction, have been difficult and expensive to fabricate since they must be high precision devices and have together with the force storage devices generally been the most expensive parts of the tap changer.

For a tap changer of the reactor switching type, the described known motor drive together with the transmission downstream thereof and especially the maltese or geneva escapement and the lever reversing transmission it was required to fulfill the following functions in a tap changer:

generating a rotational torque with subsequent conversion into a movement for the fine selector as well as, separately therefrom, the preselector;

actuation of the bypass;

drawing in the force accumulation following actuation of the vacuum switchover cells;

position indication;

record end or stop function.

Overall the conventional motor drives and their transmissions downstream for these applications have also been of complex construction, expensive to fabricate since high precision is necessary and they also together with the force accumulator usually make up the most expensive part of the overall tap changer.

The object of the invention is to provide a drastic simplification of the basic structure of tap changes as have been established over the past decade and have been fixed in the state of the art.

These objects are achieved with a tap changer with the features of the co-equal patent claims 1 or 6 or 11;

The dependent claims relate to respective advantageous possible features and modifications of the invention.

The invention presents as the general inventive concept the use of at least one torque motor known per se as a component of the drive train or drive stand of a tap changer.

Such torque motors are for example known from the brochures "Brushless Torque Motors" of the firm Etel. Such a known torque motor functions on the same functional basis as a linear drive except that the flat lying stator here is wound into a circle. A torque motor is a servo motor optimized to a high torque. Modern configurations from an electrical point of view include three phase brushless synchronous motors with permanent excitation. They are used currently in machine tool fabrication. Up to now they have not been utilized or tested in tap changers or implemented there or found to be utilized basically in tap changer drives.

It is true that in the East German Patent 58131 from 1967, experiments were described which were directed to abandoning conventional drive concepts for tap changers. The solution there, however, was to provide a tap changer with as many hydraulically actuated individual drive modules as there were steps or taps to be switched so that optionally between individual transformer winding taps and not only between neighboring taps, a switching could be carried out. This hydraulic solution however never found realization because of the high functioning risks, for example the danger of aging in the seals and the hydraulic medium lines.

For switching apparatus generally, various other drive mechanisms have been proposed. Thus for example EP 996 135 relates to a magnetic traveling wave drive for a switching device, WO 99/60591 and WO 00/05735 describe stepping motor type drives for switching devices. These solutions also have not been found to be usable directly for tap changers since they do not allow for a spring like movement and overall are problematical for realizing dynamic switch operations particularly at low temperatures.

Finally, in WO 01/06528 a controlled drive has been proposed for a switching device which also has not been found to be suitable for a tap changer.

The provision according to the invention whereby at least one torque motor is used for the drive of a tap changer has not been suggested by the developments in drive technology for switching devices generally.

According to the invention, such a torque motor can be a component of a tap changer at various points or can be built into the tap changer at various locations. It can be arranged outside the transformer housing or chamber and, indeed, above the transformer or laterally of the transformer. It can however also be arranged within the transformer chamber or housing and can there replace the force accumulator of the load switch, the fine selector drive or also the preselector drive or also a plurality of those components.

The use according to the invention of one or more torque motors whereby newly structured positioning devices can be formed, has numerous advantages. Firstly, neither clutches nor separate transmissions are required which significantly reduce the number of parts. Furthermore, it enables a compact construction to be realized. Because of reduced elasticity or play, there is a high degree of stiffness and because of the reduced mass and minimal inertia, a higher dynamic with the possibility of achieving spring like or jump or step function responses to thereby make the conventional force accumulator superfluous.

Figure 3:
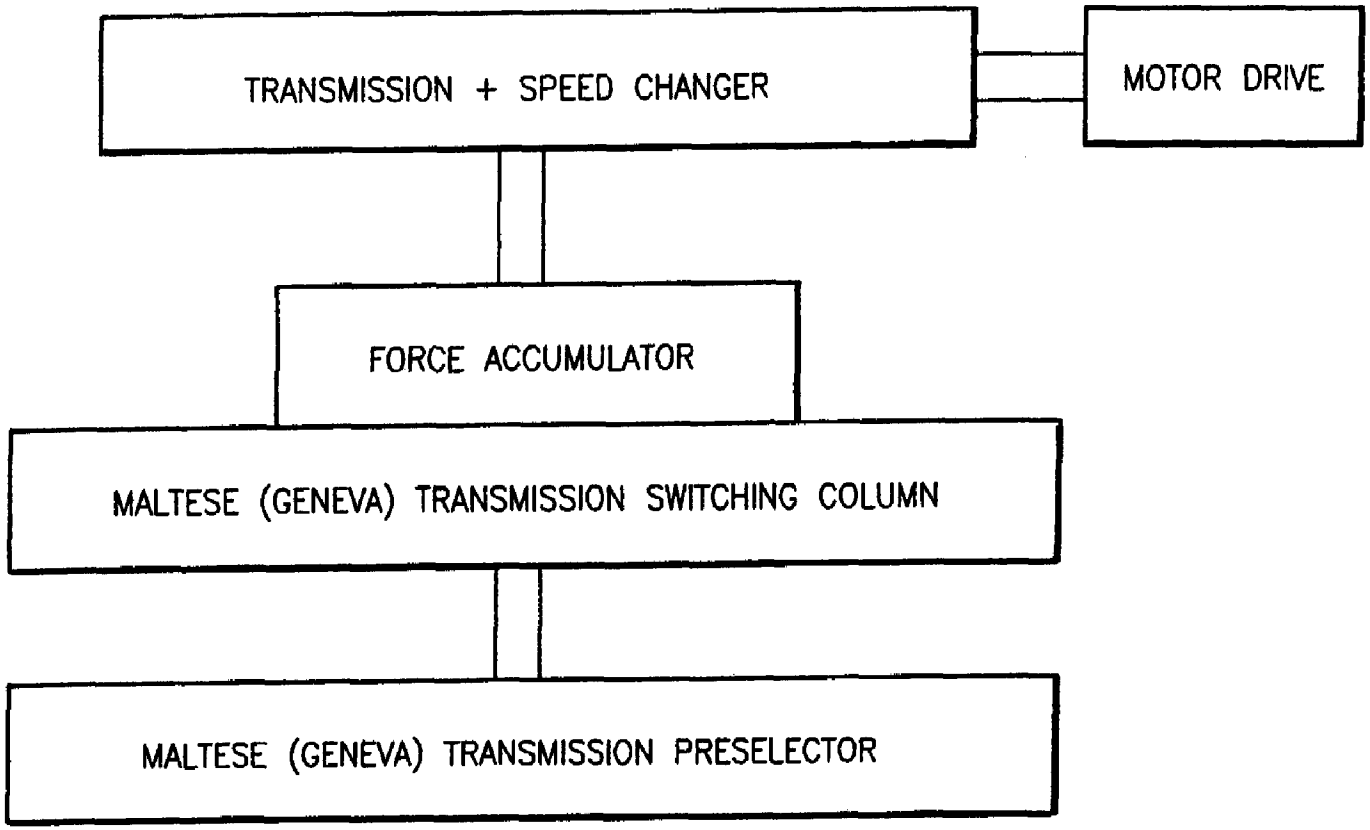
Fig. 3 PRIOR ART

Finally using a suitable control each respective switching step can be impressed independently from specially effective coutermovements so that, for example, temperature influences can be largely excluded. The invention will be described in greater detail in the following based upon the schematic illustrations which show:

FIGS. 1 through 3 previously described drive trains or sequences of known tap changers of the resistance rapid acting type in schematic illustration.

FIGS. 4*a*, 4*b* and 5*a* and 5*b* schematic possibilities of the application of the invention of at least one torque motor in an under-load tap changer of this type.

Figure 6A:
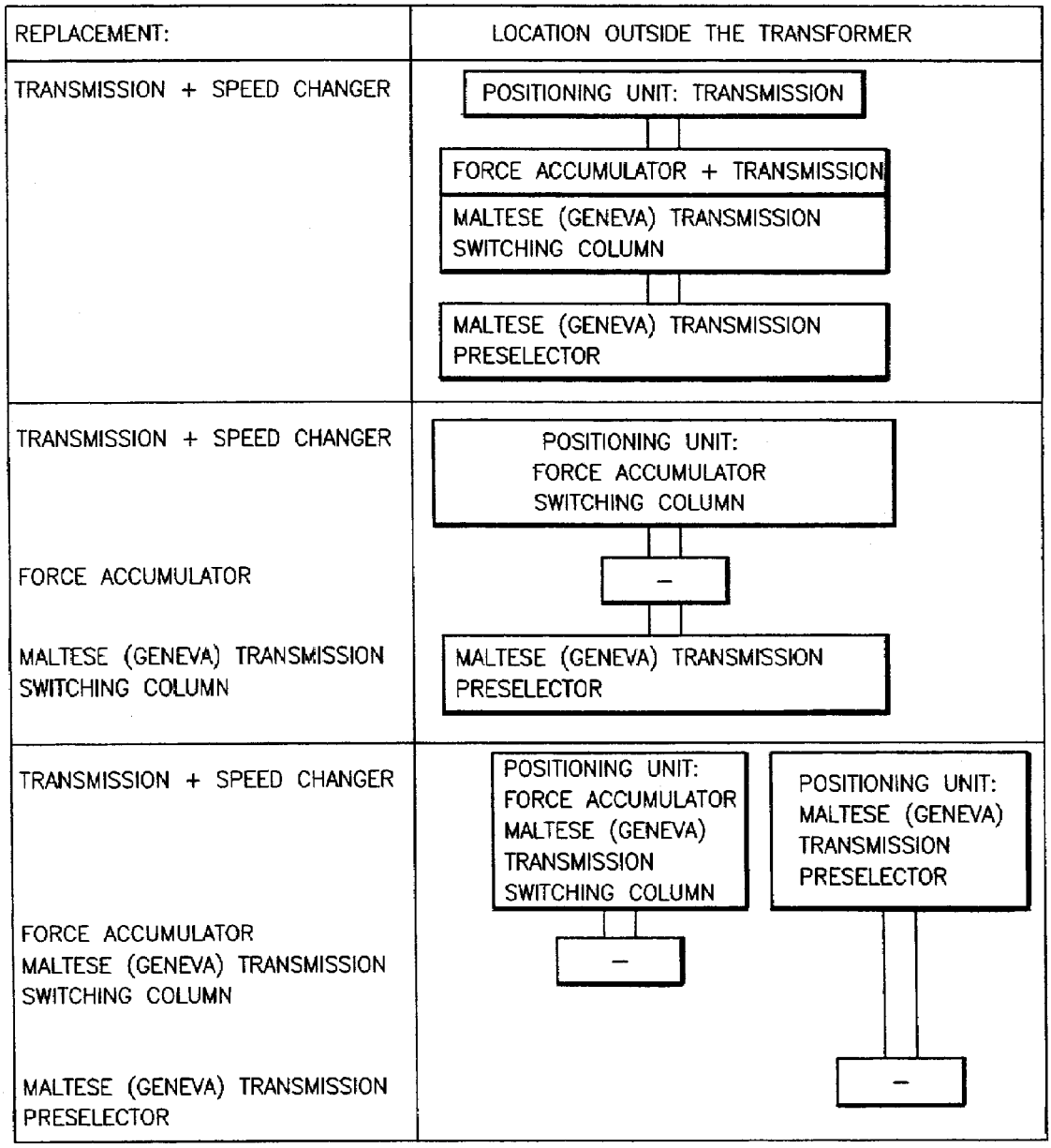

FIGS. 6*a*, 6*b* schematic possibilities of the application in accordance with the invention of at least one torque motor in a load selector of this type.

FIGS. 7 and 8 previously described drive trains or drive sequences of known tap changers of the reactor type in schematic illustrations.

FIGS. 9*a*, 9*b*, 10*a*, 10*b*, 11*a* and 11*b* schematic possibilities of the application according to the invention of at least one torque motor in a first tap changer of this type.

Figure 12A:
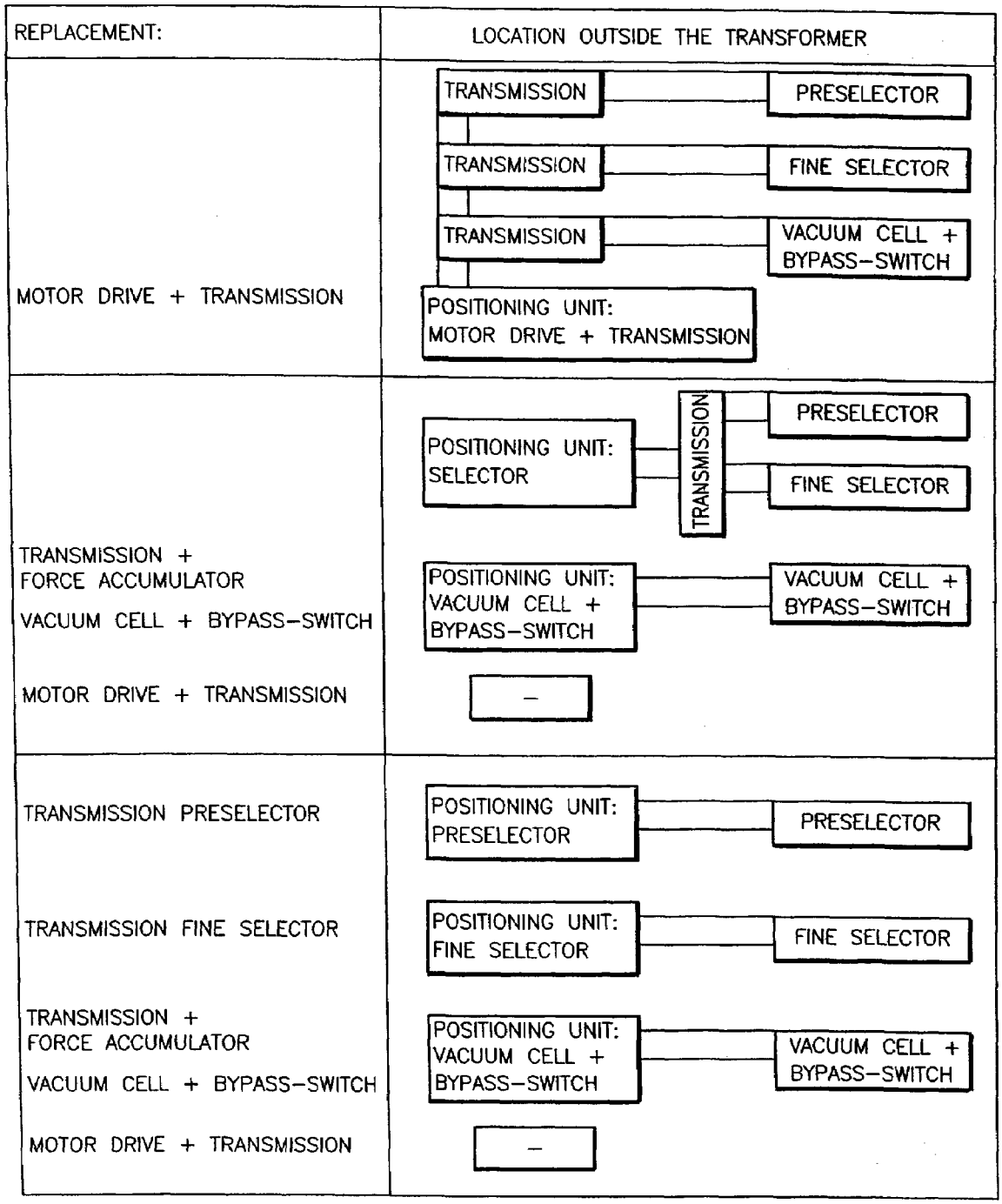
Figure 12B:
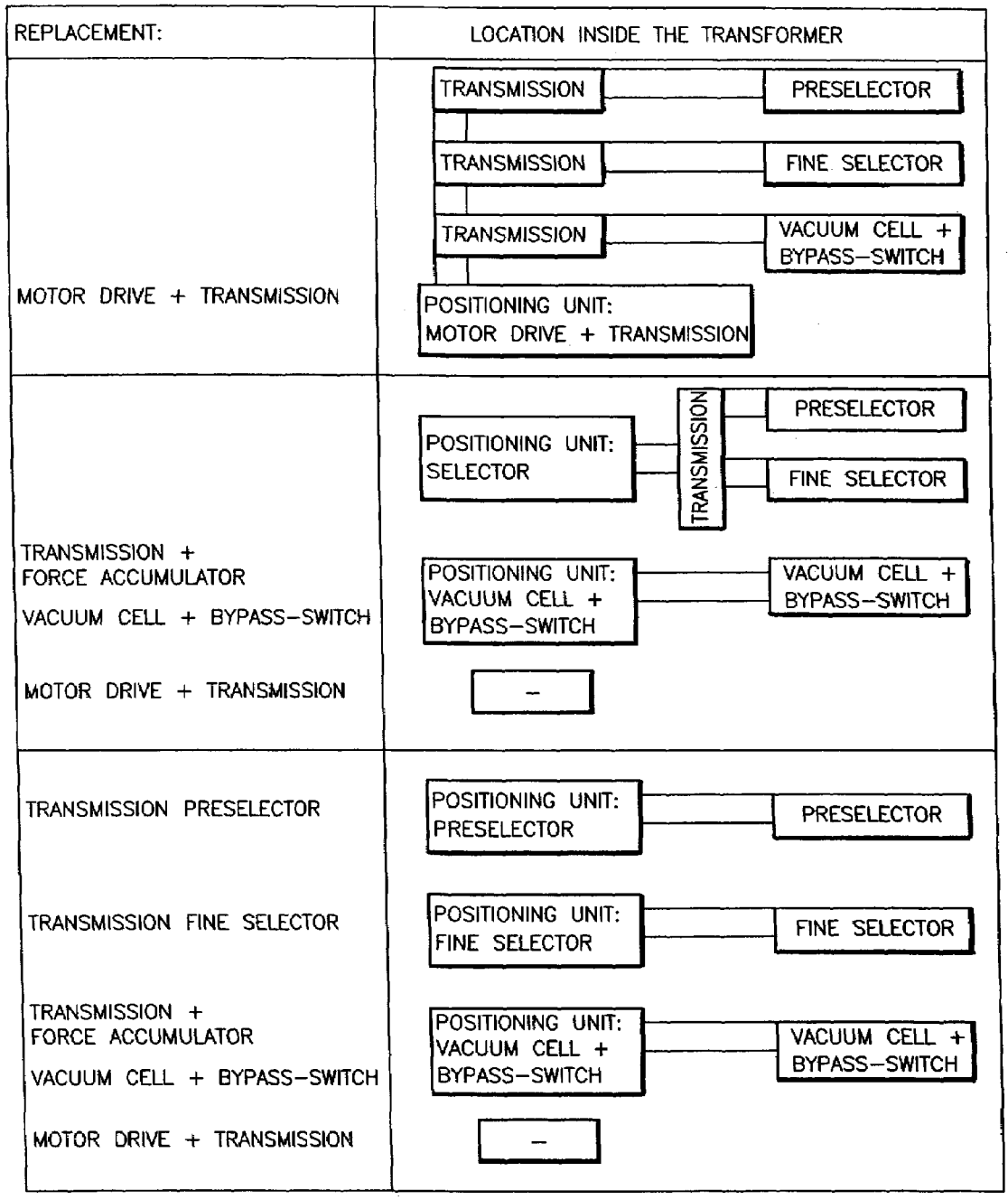

FIGS. 12*a*, 12*b* schematic possibilities of the application according to the invention of at least one torque motor in a second tap changer of this type.

In the following schematic illustrations, the components according to the invention, each of which contains a torque motor, are respectively designated as "positioning unit" and indicated in a gray background. In each field the concrete function has been written in which is carried out by the respective torque motor, that is the respective positioning unit.

In FIG. 4*a* the configuration of a tap changer located externally of the transformer has been shown and here, according to the intention has a torque motor which has replaced the previous motor drive and the transmission downstream thereof and directly acts upon the force accumulator of the load switch, the maltese or geneva escapement or drive of the fine selector and optionally upon the preselector or course selector. Beneath it a further embodiment of the intention has been schematically illustrated in which a torque motor also replaces the previous force accumulator in accordance with the state of the art and the associated transmission in which this new positioning unit with the torque motor acts directly upon the maltese or geneva drive of the fine selector and optionally on the preselector as well as directly on the load switch. The second embodiment can as a whole also be located within the transformer as shown in FIG. 4*a*.

Figure 5A:
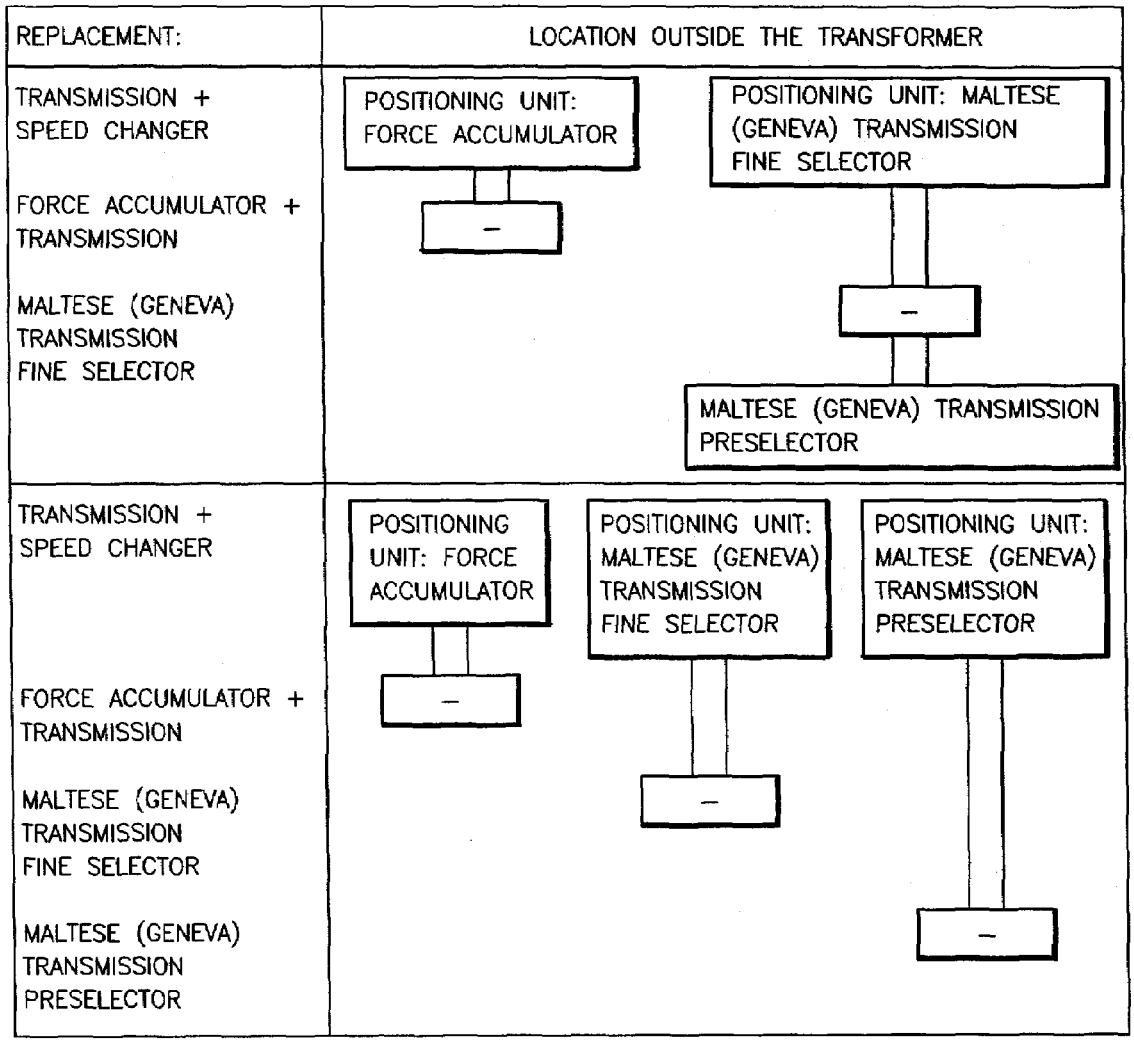

In FIGS. 5*a* and 5*b*, further embodiments of the invention have been schematically illustrated.

In FIG. 5*a*, a construction of the tap changer externally of the transformer has been shown in which a first torque motor, according to the invention directly actuates the load switch in that it also makes superfluous the previous force accumulation (left hand positioning unit); a further torque motor (right hand positioning unit) actuates directly the maltese or geneva drive of the fine selector and optionally the preselector. In contrast to the embodiment of the invention in FIGS. 4*a* and 4*b* in which receptively only a single torque motor has been provided, here a plurality of such positioning units with torque motors are shown.

There below, is than a further modified embodiment of the invention which has a total of three such torque motors. A first positioning unit according to the invention (left) actuates directly-eliminating the previous force accumulator the load switch, a second positioning unit (center) actuates directly the fine selector, and a third positioning unit (right) directly actuates the preselector if one is provided. In FIG. 5*b*, these embodiments of the invention are shown in a configuration of the tap changer located within the transformer.

In FIGS. 6*a* and 6*b* with the same type of scholastic illustration, possible embodiments of the invention of the tap changer of the load selection type have been shown.

FIG. 6*a* again shows the arrangement of the tap changer externally of the transformer. FIG. 6*b* shows the arrangement within the transformer.

The upper illustration in each discloses an embodiment in which a torque motor directly actuates the force accumulator which in a conventional manner drives the switching column with a spring action and additional can optionally operate the preselector. The middle illustrations shows receptively embodiments of the invention in which the torque motor also assumes the function of the prior force accumulator and directly derives the switching column with the spring like jump or impulsive rotation. The lower illustration finally shows in each case an embodiment with two separate torque motors such that the first of these new positioning units directly rotate the switching column with the spring like impulsive action and the second positioning unit separately actuates a preselector if one is provided.

Figure 9A:
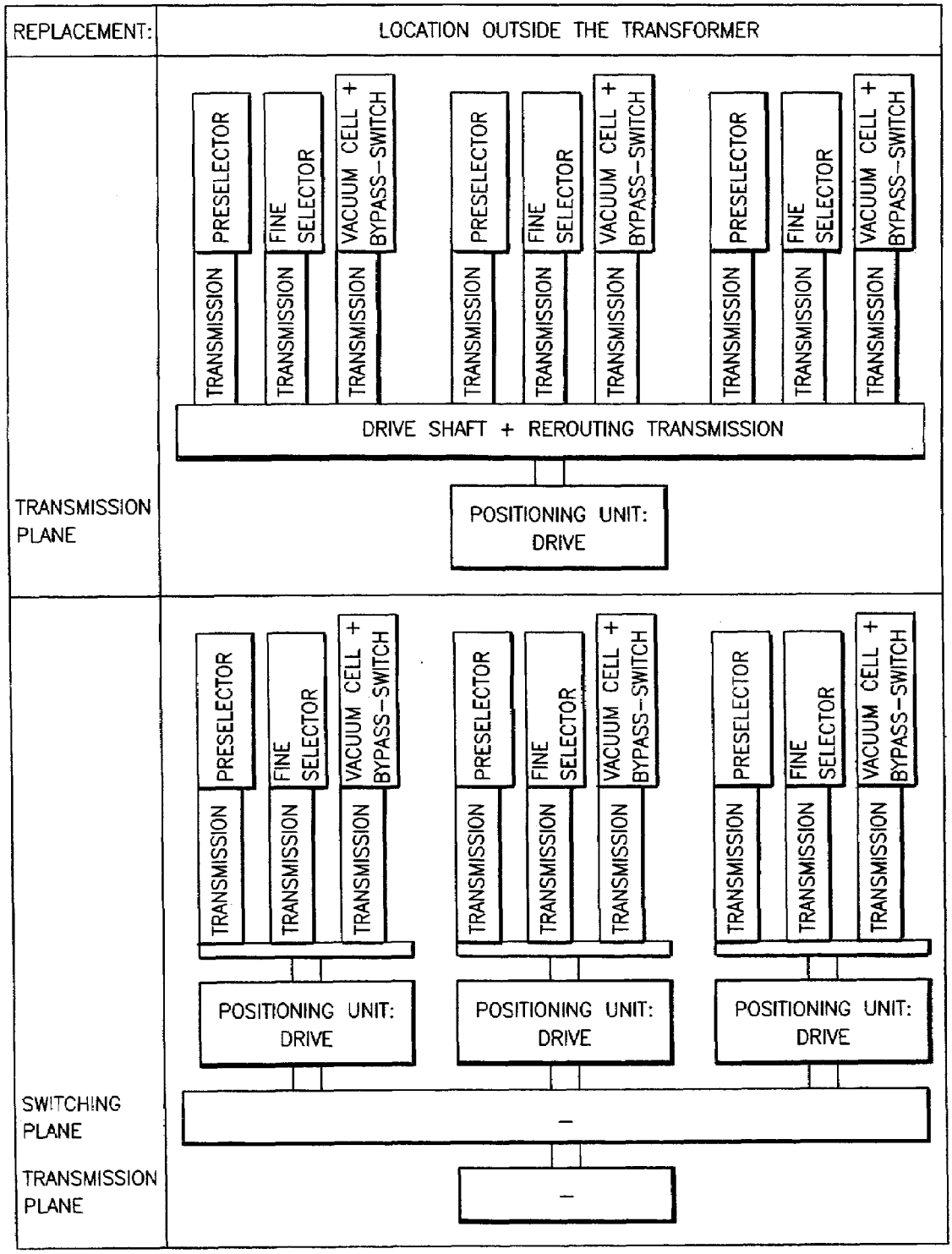

In FIG. 9*a*, the arrangement of the tap changer externally of the transformer has been shown in the upper half of the illustration there, according to the invention, a torque motor replaces the entire motor drive and acts directly on the drive shaft and the rerouting transmission. The drive shaft in turn actuates in each phase the preselector, fine selector, bypass contact as well as through the force accumulator (not shown), the vacuum switching cell. There below a further embodiment of the invention has been schematically illustrated which a torque motor in each phase forms respectively a new positioning unit and the positioning units act upon the previous remounting transmission or drive.

Figure 9B:
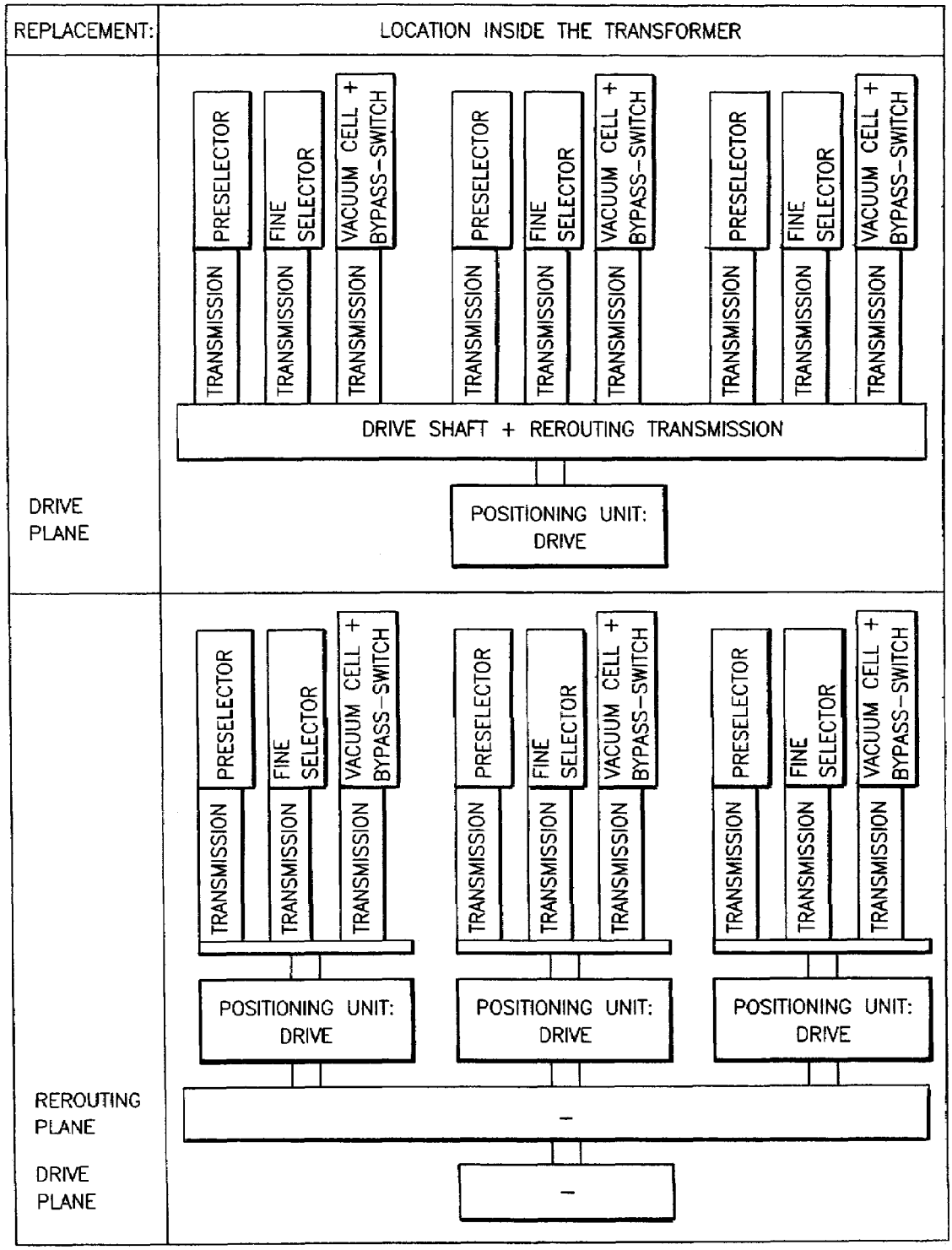

FIG. 9*b* shows a corresponding arrangement for a tap changer located within the transformer.

Figure 10A:
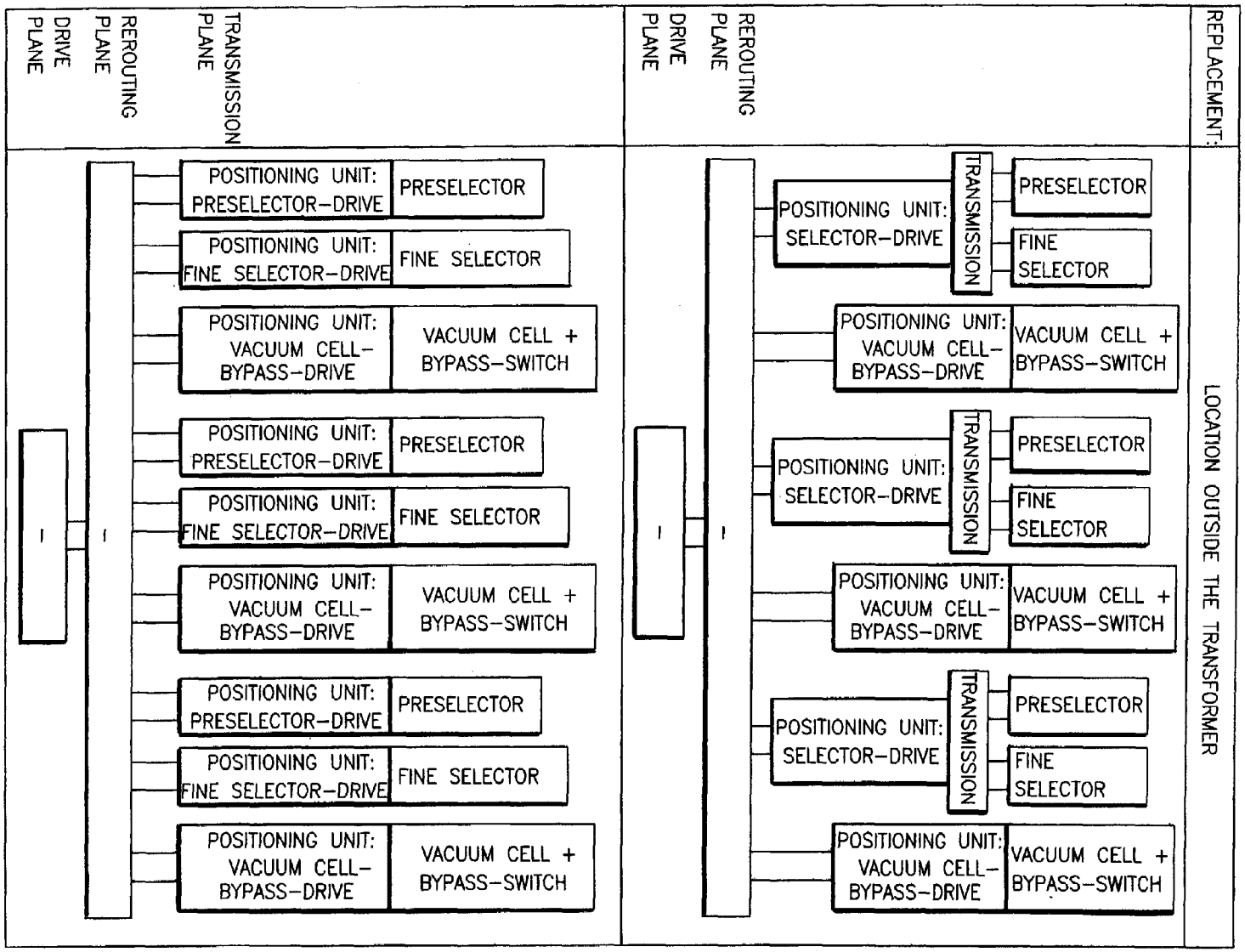
Figure 10B:
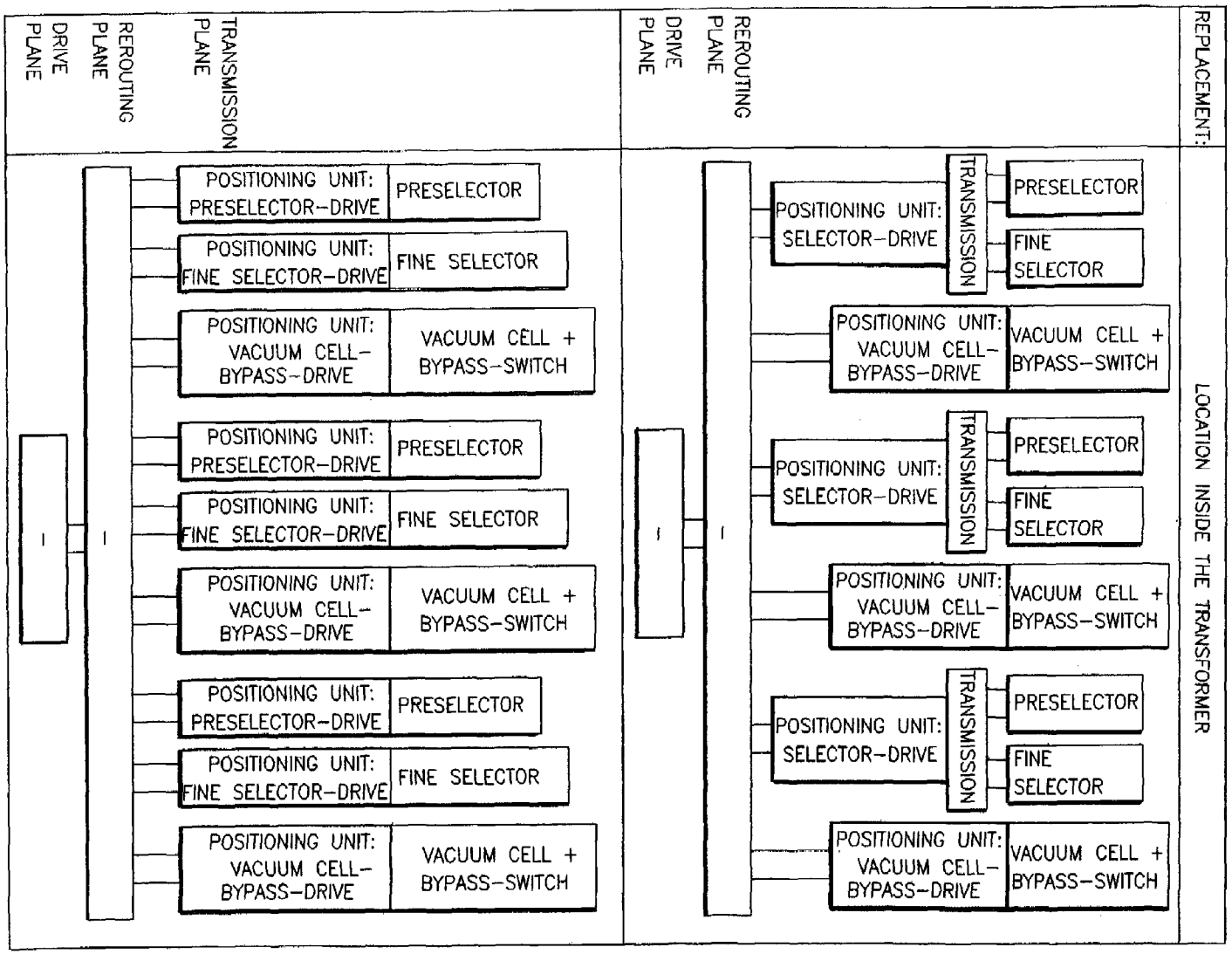

In FIGS. 10*a* and 10*b* further embodiments of the invention have been schematically illustrated.

In the upper part of FIG. 10*a*, in each phase a first torque motor is shown whose transmission simultaneously actuates the preselector a fine selector while a respective second torque motor actuates the bypass contact as well as the vacuum switching cell through a force accumulator which can be loaded by that second torque motor. There below a further embodiment of the invention is illustrated in which in each phase a total of three such torque motors are provided which together with the corresponding transmissions form an independent positioning unit and act directly upon the preselector or fine selector or the bypass switch as well as upon the force accumulator of the vacuum switching cell.

FIG. 10*b* shows these embodiments again for an arrangement of the tap changer within the transformer.

Figure 11A:
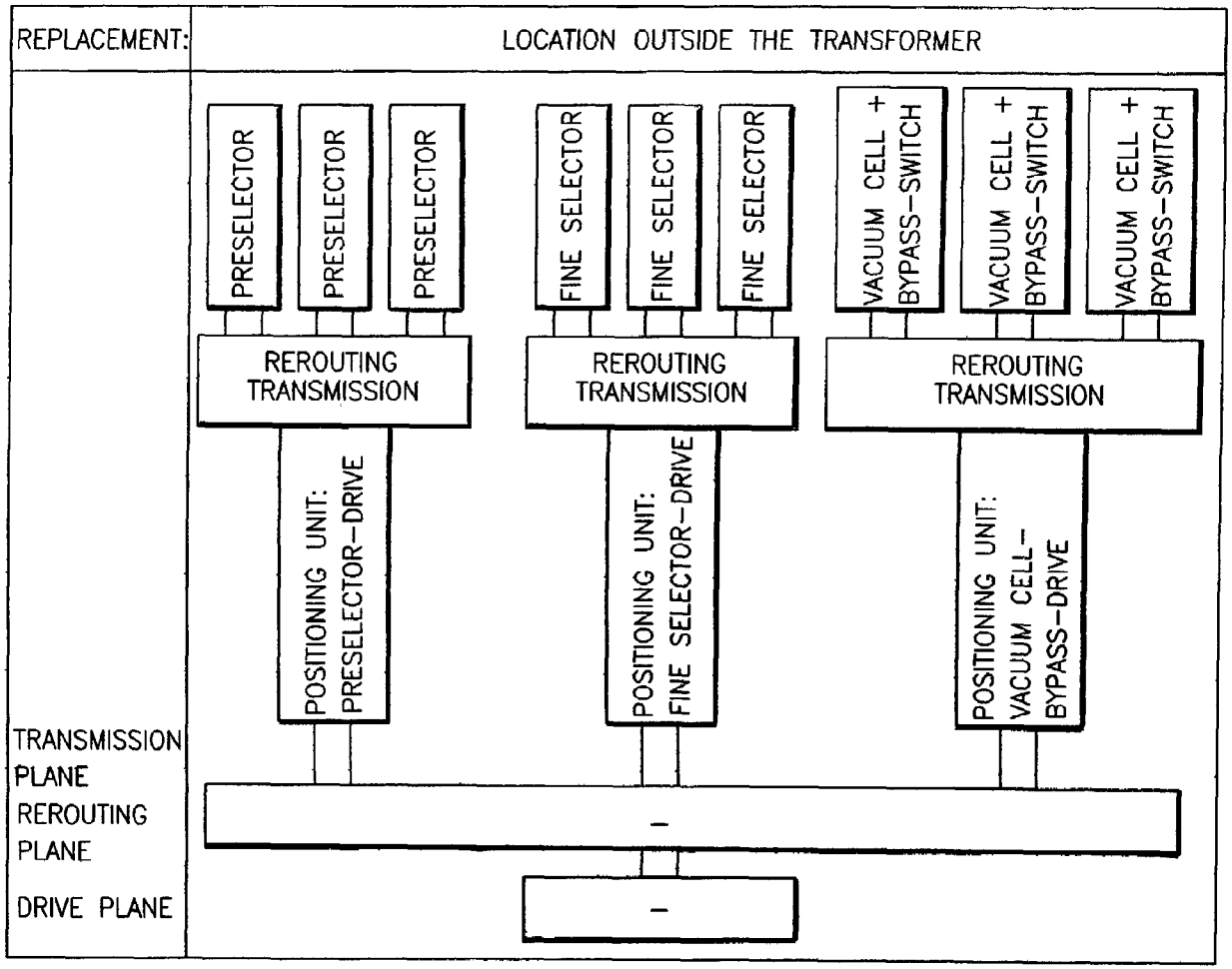
Figure 11B:
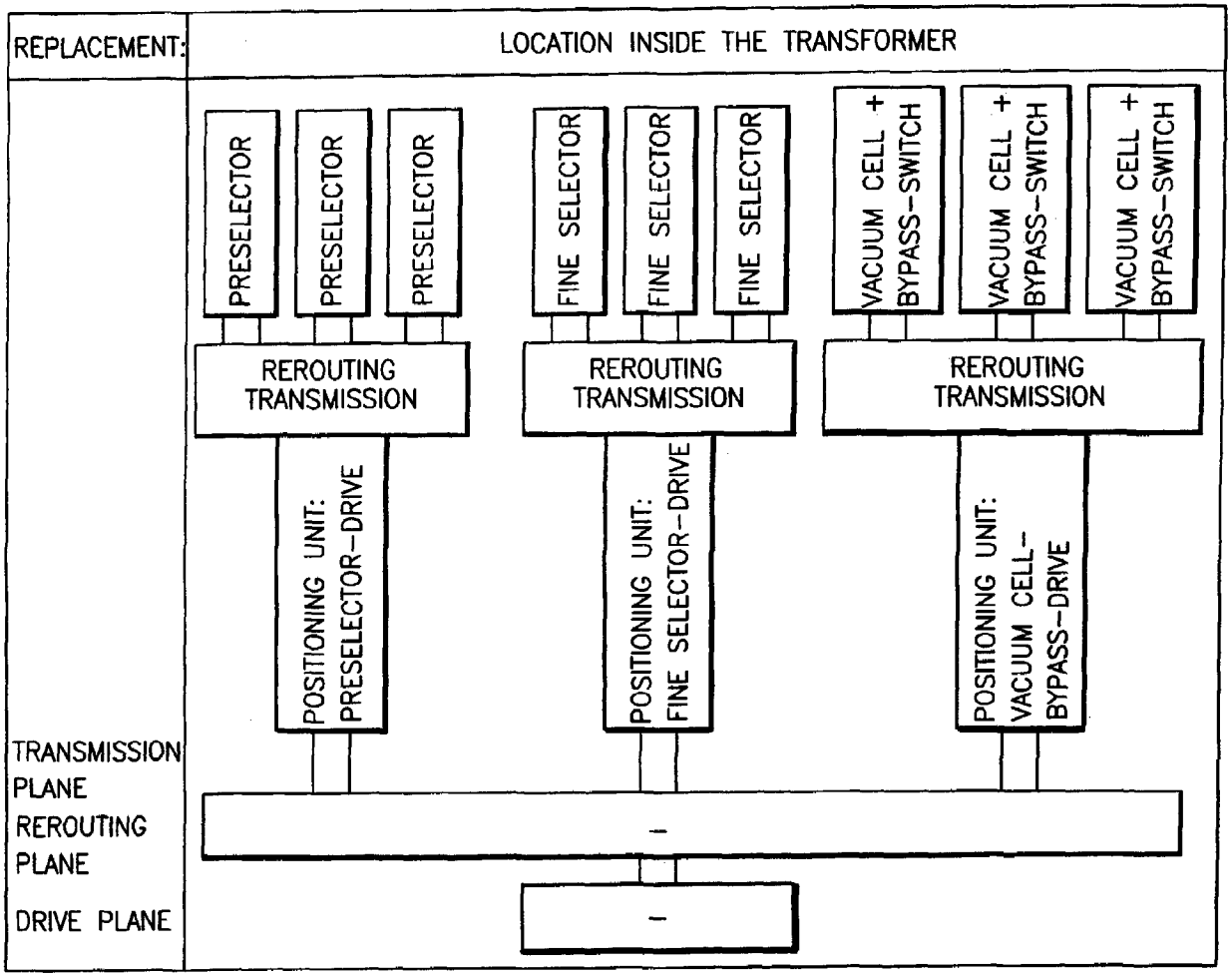

In FIGS. 11*a* and 11*b* further modified embodiments of the invention are illustrated. In these embodiments the need for certain individual components of previously used systems can be eliminated. A first torque motor here actuates the preselectors of all three phases, a second torque motor the fine selector of all three phases and a third torque motor both the bypass contacts as well as the force actuators and therewith the vacuum switching cells of all three phases.

In FIGS. 12*a* and 12*b* in the same type of schematic illustration, possible embodiments of the invention of a tap changer of another conventional type have been shown and whose known drive train according to the state of the art has been illustrated in FIG. 8 and already described. The upper illustrations show respectively embodiments in which a single torque motor actuates through respective intervening transmissions, the preselector, the fine selector and simultaneously the bypass contact and vacuum switching cell, again through a force actuator. The middle illustration There below shows respectively in each phase two such torque motors. A preselected and fine selector is actuated by one of them and the other actuates the bypass contact and the force accumulator for the vacuum switching cell.

Finally at the bottom further variants have been shown in which in each phase three torque motors are provided for actuation:

one for the preselector, one for the fine selector and one for the bypass and the force accumulator of the vacuum cell. Here as well it is possible to provide a phase-wise arrangement and for all of the illustrated arrangements in FIGS. 12*a* and 12*b* the actuation of the individual described components simultaneously for all three phases by respective positioning units. The described FIG. 12*a* applies to the arrangement of the tap changer outside the transformer and FIG. 12*b* to its arrangement within the transformer.

The invention claimed is:

1. A tap changer for the interruption-free switching between different winding taps of tapped transformer in accordance and the principle of a resistance-type rapid acting switch, the tap changer comprising a fine selector and optionally of a preselector for the powerless selection of the winding tap to which a subsequent switchover is to be effected, a load switch for the subsequent rapid switchover from the previous winding tap to the selected winding tap with a brief insertion of at least one bridging resistance, and drive means including a torque motor for actuating the fine selector, the optional preselector and also the load switch.

2. The tap changer according to claim 1 wherein the torque motor as well as a known force accumulator actuate the load switch as well as the fine selector and optional preselector.

3. The tap changer according to claim 1 wherein the torque motor actuates directly both the load switch and the fine selector and optional preselector.

4. The tap changer according to claim 1 wherein the torque motor directly actuates the known force accumulator of the load switch and the drive means includes at least one second torque motor that actuates the fine selector and optional preselector.

5. The tap changer according to claim 1 wherein the torque motor actuates the load switch directly and the drive means includes at least one second torque motor that actuates the fine selector and optionally a third torque motor that actuates the preselector.

6. The tap changer according to claim 1 wherein the load switch on the one hand and the fine selector and optional preselector on the other are arranged to be specially separate from one another and/or the fine selector and optional preselector are separately drivable by at least one stepping motor.

7. A tap changer for uninterrupted switching between different winding taps of a tapped transformer in accordance with the principle of a resistance-type rapid switch, comprised of the tap changer comprising a load selector for the simultaneous selection of the winding tap to which switchover is to be effected, as well as for the rapid switchover for the previous to the selected winding tap with brief insertion of bridging resistance, a spring like jump switching element a switching column is provided, for the switchover, and drive means for that switching element including a torque motor.

8. The tap changer according to claim 7 wherein the torque motor directly actuates a known force accumulator which in turn displaces the switch element with a spring like jump in known manner and also actuates any optional preselector.

9. The tap changer according to claim 7 wherein the torque motor directly displaces the switch element with the spring like jump and also operates any optional preselector.

10. The tap changer according to claim 7 wherein the torque motor directly displaces the switch element with the spring like jump and the drive means includes at least one second torque motor that directly actuates the preselector.

11. The tap changer for uninterrupted switching between different winding taps of a tap transformer in accordance with the principle of a reactor switching, the tap changer comprising a fine selector with two load branches between which in each of the switching phases a vacuum switching cell is arranged, a preselector comprised of a bypass contact which bridges the vacuum switching cells respectively and in turn connects at least one of the two load branches with the load output line as well as a force accumulators which actuates the respective vacuum switching cell;

a single drive is provided which by means of various transmissions and drive shafts actuates all of the mentioned parts, the drive including at least one torque motor.

12. The tap changer according to claim 11 wherein the torque motor actuates all drive shafts.

13. The tap changer according to claim 11 wherein the drive includes three separate torque motors so arranged that each of them actuates the parts of one phase, namely, the preselector, fine selector, bypass contact and force accumulator of the vacuum switching cell.

14. The tap changer according to claim 11 wherein the drive means has for each phase other separate torque motors, one of which actuates a preselector and fine selector and the other of which actuates the bypass contact and force accumulator of the vacuum switching cell.

15. The tap changer according to claim 11 wherein the drive means has for each phase three separate torque motors of which one actuates the fine selector and one actuates both the bypass contact and also the force accumulator of the vacuum switching cell.

16. The tap changer according to claim 11 wherein the drive means has a total of three separate torque motors of which one actuates the preselectors of all three phases, one other actuates the fine selectors of all three phases and the third both the bypass contacts and also the force actuator of the vacuum switching cells.

* * * * *